US009540160B2

(12) United States Patent
Gruterich

(10) Patent No.: US 9,540,160 B2
(45) Date of Patent: Jan. 10, 2017

(54) PACKAGING FOR FILLER MATERIALS

(75) Inventor: Klaus Gruterich, Damme (DE)

(73) Assignee: Nordfolien GmbH, Steinfeld (DE)

( * ) Notice: Subject to any disclaimer, the term of this patent is extended or adjusted under 35 U.S.C. 154(b) by 0 days.

(21) Appl. No.: 14/009,516

(22) PCT Filed: Mar. 22, 2012

(86) PCT No.: PCT/DE2012/000301

§ 371 (c)(1),
(2), (4) Date: Mar. 2, 2015

(87) PCT Pub. No.: WO2012/136186

PCT Pub. Date: Oct. 11, 2012

(65) Prior Publication Data

US 2015/0225159 A1 Aug. 13, 2015

(30) Foreign Application Priority Data

Apr. 2, 2011 (DE) ..... 20 2011 004 802 U

(51) Int. Cl.
*B65D 75/00* (2006.01)
*B65D 75/58* (2006.01)
(Continued)

(52) U.S. Cl.
CPC ..... *B65D 75/5827* (2013.01); *B65D 33/16* (2013.01); *B65D 75/008* (2013.01); *B65D 75/566* (2013.01);
(Continued)

(58) Field of Classification Search
CPC ..... B65D 31/005; B65D 31/02; B65D 33/20; B65D 75/00; B65D 75/5805; B65D 75/5816; B65D 75/12; B65D 75/5827; B65D 33/16; B65D 75/008; B65D 75/566; B65D 77/12; B65D 2575/586
(Continued)

(56) References Cited

U.S. PATENT DOCUMENTS 3,647,386 A * 3/1972 Gilford ..... B01L 3/505 206/221
4,201,299 A * 5/1980 Bumgarner ..... B65D 33/001 206/554
(Continued)

FOREIGN PATENT DOCUMENTS

DE 1918528 U * 6/1965
DE 1479650 * 6/1969
(Continued)

OTHER PUBLICATIONS

WO 2012/136186 A1—Publication of PCT/DE2012/000301 published by WIPO.
(Continued)

*Primary Examiner* — Peter Helvey
(74) *Attorney, Agent, or Firm* — Faier & Faier P.C.; James M. Faier; Martin Faier

(57) ABSTRACT

In a packaging for filler materials, in particular a bag or pouch made of a plastic film, with a packaging wall enclosing the filler material, which is formed by means of at least one front and rear wall (2, 3, 22, 23), wherein the front and rear wall are joined to one another in the base region (5, 25) via a stand base (4, 24), which is formed from at least two inner layers of an in-fold of a tubular web section folded at least on one side in the longitudinal direction; the front and rear walls (2, 3, 22, 23) each have a fold-over (7, 8, 27, 28) in the header region (6, 26) of the packaging (1, 21), wherein the upper wall section of one of the walls (2, 23) is folded over upon itself so as to form a multi-layer region (16, 40),
(Continued)

and wherein the upper wall section of the other wall (3, 22) is folded over with its inner face onto the multi-layer region (16, 40) so as to form an overlap region (17, 41), and in the overlap region (17, 41) at least one joining seam (9, 29) is provided, by means of which certain layers of the walls (2, 3, 22, 23) of the packaging (1, 21) are at least partially joined together to form a closure.

15 Claims, 3 Drawing Sheets

(51) Int. Cl.
*B65D 33/16* (2006.01)
*B65D 75/56* (2006.01)
*B65D 77/12* (2006.01)

(52) U.S. Cl.
CPC ..... *B65D 75/5805* (2013.01); *B65D 77/12* (2013.01); *B65D 2575/586* (2013.01)

(58) Field of Classification Search
USPC ..... 383/88, 208
See application file for complete search history.

(56) References Cited

U.S. PATENT DOCUMENTS 5,288,003 A * 2/1994 MacDonald ..... B60R 9/055 224/311
5,937,617 A * 8/1999 Yeager ..... B31B 19/84 206/217
6,245,367 B1 * 6/2001 Galomb ..... B65D 51/247 206/541
6,254,907 B1 * 7/2001 Galomb ..... B65D 51/247 206/541
6,361,209 B1 * 3/2002 LaRue ..... B65D 33/2591 383/10
6,435,350 B1 * 8/2002 Huang ..... B26D 3/12 206/554
6,957,914 B2 * 10/2005 Arends ..... B65D 33/06 383/204
8,196,873 B2 * 6/2012 Kohn ..... A47F 9/042 248/100
8,622,618 B2 * 1/2014 Moehlenbrock ..... B65D 33/16 383/203
2001/0017950 A1 * 8/2001 Strand ..... B31B 19/90 383/204
2003/0205497 A1 * 11/2003 Strickland ..... A47F 13/085 206/554
2005/0061707 A1 * 3/2005 Naelitz-Thomas .... A45C 11/20 206/541
2005/0139508 A1 * 6/2005 Su ..... B31B 37/00 206/554
2005/0220368 A1 * 10/2005 Kohn ..... B65D 33/14 383/9
2005/0244084 A1 * 11/2005 Tilman ..... B65D 75/008 383/64
2006/0003879 A1 * 1/2006 Buchman ..... B31B 19/90 493/213
2006/0204148 A1 * 9/2006 Kohn ..... A47F 9/042 383/9
2007/0086683 A1 * 4/2007 Yeager ..... B65D 31/10 383/95
2008/0044113 A1 * 2/2008 Tilman ..... B65D 81/2038 383/103
2009/0324143 A1 * 12/2009 Sharp ..... B65D 31/02 383/109
2010/0067831 A1 * 3/2010 Alvarado ..... B65D 33/001 383/37
2012/0195527 A1 * 8/2012 Moehlenbrock ..... B65B 9/08 383/42
2012/0328746 A1 * 12/2012 Perick ..... B32B 5/18 426/127
2014/0044379 A1 * 2/2014 Gum ..... B65D 75/008 383/12
2014/0120207 A1 * 5/2014 Steele ..... A47G 21/12 426/2
2014/0314342 A1 * 10/2014 Verma ..... B65B 67/1255 383/34
2015/0063728 A1 * 3/2015 Dunkle ..... B65D 33/20 383/9

FOREIGN PATENT DOCUMENTS

DE 2622659 12/1977
DE 20115181 2/2002
FR 1600917 9/1970

OTHER PUBLICATIONS

International Search Report for PCT/DE2012/000301 published by WIPO.
German Search report for German Priority Document 20 2011 004 802.0.

* cited by examiner

PACKAGING FOR FILLER MATERIALS

CLAIM OF PRIORITY

This application is a U.S. National Stage filing under 35 U.S.C. 371 of PCT/DE2012/000301 filed 22 Mar. 2012 which draws priority from German patent application serial number 20 2011 004 802.0 filed 2 Apr. 2011.

BACKGROUND OF THE INVENTION

The invention relates to a packaging for filler materials, in particular a bag or pouch made of a plastic film, with a packaging wall enclosing the filler material, which is formed by means of at least one front wall and one rear wall, wherein the front and rear walls are joined together in the base region by means of a stand base that is formed from at least two inner layers of an in-fold of a tubular web section folded at least on one face in the longitudinal direction.

Packagings of the genus described above, which, for example, are produced from a flexible material, are deployed so as to enclose in particular loosely-filled or free-flowing filler materials, such as, for example, foodstuffs, fertilisers, or similar products. Such filler materials are manufactured in the food industry, or the chemicals industry, amongst others, or are also used for further processing. With the aid of the packagings, such as for example bags or pouches made of a plastic film, it is possible to transport and store temporarily the thereby accommodated filler materials before they are, for example, supplied for further processing, or, in the case of a finished end product, to bring them directly to market.

From DE 19 18 528 U1, for example, a pouch with a packaging wall made of a plastic film enclosing the filler material is of known art. The pouch has a front wall and a rear wall formed from a tube; in the base region the walls are joined together via a stand base, and in the side regions via side seams. The stand base is thereby formed from at least two inner layers of an in-fold, which is present in the form of an otherwise conventional side fold inserted between the front and rear walls of a tubular web section folded on at least one side in the longitudinal direction. In a similar manner to the base region, In the header region of the pouch the upper, but separated from one another, wall sections of the front and rear walls are turned inwards, wherein a filling opening is created. After filling the front and rear walls together with the inwardly turned over wall sections are joined so as to close the header region of the pouch by means of a joining seam running at the height of the ends of the turned wall sections. With the aid of the joining seam the pouch is both sealed closed and at the same time the layers in the header region lying one upon another are fixed together. In order to ensure a secure connection of the layers together at all times a relatively accurate folding of the upper wall sections of the front and rear walls must be undertaken. In particular the inwardly turned over sections must be arranged relative to one another in a congruent manner, as a result of which the manufacture of such a packaging is associated with increased constructive effort.

The object underlying the invention is therefore to create a packaging that can be manufactured in a simplified manner.

The object is inventively achieved by means of a packaging with the features of the protective Claim 1. Advantageous further developments and configurations of the invention are specified in Claims 2 to 11.

In a packaging for filler materials, in particular a bag or pouch made of a plastic film, with a packaging wall enclosing the filler material, which is formed by means of at least one front and rear wall, wherein the front and rear walls are joined together in the base region via a stand base, which is formed out of the at least two inner layers of an in-fold of a tubular web section folded on at least one side in the longitudinal direction, provision is made in accordance with the invention that the front and rear walls in the header region of the packaging in each case have a fold-over, wherein the upper wall section of one of the walls is folded upon itself so as to form a multi-layer region, and wherein the upper wall section of the other wall is folded over so as to form an overlap region with its wall inner face on the multi-layer region, and that provision is made for at least one joining seam in the overlap region, by means of which certain layers of the walls are joined together, at least partially closing the packaging.

With the aid of such an inventively designed header region a simplified and at the same time more secure closure of the packaging is ensured. In particular by means of the overlap region between the surface area sections of the wall section of the one wall folded one upon another, and the wall inner face of the wall section of the other wall of the packaging turned over the multi-layer region an advantageously large surface area contact region is created. Moreover with just a single joining seam a permanently secure joint is possible between the wall sections of the front and rear walls, and thus a secure closure of the packaging. With the folding one upon another of the upper wall section of the front wall in particular a two layer region arises, for example, which, after the turning of the rear wall onto the multi-layer region of the front wall and thus the overlap of predetermined surface area sections, is then formed from four layers. As a result of the four layers the header region has a relatively high strength. With the aid of the joining seam, which, for example, runs above and parallel to the end of the wall section of the rear wall turned onto the multi-layer region, at least one secure material bond is produced between the inner face of the rear wall and the adjacent layer of the multi-layer region of the front wall. It is likewise conceivable to join together more than two of the layers lying one upon another in the overlap region by means of the one joining seam.

In accordance with a first further development of the invention, provision is made for the multi-layer region to be formed by the laying one upon another of surface area sections of the inner face of the corresponding wall. The transfer of the upper wall section inward represents an advantageous opportunity for the formation of the multi-layer region of the one wall, on which the upper wall section of the other wall can then advantageously simply turn itself over. It is then possible, for example, for the outer face in particular of the front wall forming the multi-layer region and the inner face of the rear wall to overlap one another, so that the four-layer header region is thereby formed. The multi-layer header region and the multi-layer base region formed by means of an in-folding between front and rear walls, in each case can have both equal width and also different width multi-layer regions, independently of the type of folding in the header region.

Alternatively provision is made for the multi-layer region to be formed by the laying one upon another of surface area sections of the outer face of the corresponding wall. This type of folding represents an advantageously simple option for the simultaneous formation of the fold-overs on the upper wall sections of the front and rear walls aligned with one another. Here the multi-layer region and overlap region are created, in that the upper wall sections of the front and rear walls of the packaging, in particular, for example, congruently arranged relative to one another, are folded over together. Here in each case the inner faces of the front and rear walls always lie directly one upon another; these are then joined together via the joining seam. In this form of embodiment it is of advantage if in addition to the secure closure of the folded-over wall sections, the fold-overs with one of their outer faces are additionally fixed to one of the layers of the four-layer header region.

By means of the joining seam a header region is preferably formed that is separated from the fill space of the packaging. To this end the heat input in the region of the packaging provided for the joining seam, based in particular on a material bond is selected to be sufficiently high such that all layers lying one upon another in the header region are joined together. By the separation of the header region from the fill space of the packaging it is possible to avoid in an advantageously simple manner that any parts of the filler material remain trapped in the relatively narrow layers lying one upon another in the header region of the packaging during the emptying of the packaging. By this means a complete evacuation is supported. In this context the joining seam can be formed over the whole width in the header region of the packaging.

Alternatively the possibility exists of providing an additional joining seam, by means of which at least one sub-region of the multi-layer header region is separated from the fill space of the packaging. Such an inventive joining seam thereby joins in particular the wall sections of the packaging wall directly adjacent to the fill space. In particular in the embodiment whose multi-layer region is created by the laying one upon another of surface area sections of the inner face, the outer face of the folded-over wall section of the rear wall can, for example, be at least partially joined in a material bond with the inner face of the wall section of the front wall turned over the multi-layer region.

In accordance with a further development of the invention, provision is made for at least one carrying aid to be provided in the header region separated from the fill space: the carrying aid is formed as a perforation penetrating predetermined layers in the header region. With the aid of the carrying aid an advantageously simple handling of the packaging for transport using only one hand is enabled. The design of the carrying aid, in particular as a perforation in the multi-layer header region, has the advantage that in particular as a result of the advantageous strength of the four layers lying one upon another any tearing of material is avoided. Thus filler materials with a relatively high density can also be transported without any problems. The perforation in the multi-layer header region can in particular be formed as a punched-through oval, or as a material incision in the form of a letter "C" lying on its side. It is likewise conceivable, instead of a perforation completely penetrating the four-layer header region, to design the carrying aid as, for example, a grip penetrating only two of the four layers in the header region.

In particular at least one of the walls has a predetermined separation line weakening the wall material so as to form a removal region. By means of the predetermined separation line in the front wall or the rear wall of the packaging a simplified opening of the packaging is effected and thus a simplified access to the filler material in the fill space of the packaging is achieved. The deployment of separate aids for the purpose of opening the packaging can thus advantageously be avoided. Moreover a simplified removal of the filler material contained in the packaging is possible via the opening created by means of the predetermined separation line formed in the front and/or rear walls. In particular in the case of filler materials that are used for purposes of further processing, the predetermined separation line can preferably be formed over the whole length or width on one of the walls, or also on both walls of the packaging. If the predetermined separation line is provided on both packaging walls, it is possible if necessary to remove at least one part of the packaging completely.

The predetermined separation line in particular extends over at least one section underneath the multi-layer header region. The predetermined separation line is preferably formed in the two-layer region of the packaging, so that by the separation of the corresponding material regions a direct access into the fill space is always ensured. The predetermined separation line can extend in particular from a side seam underneath the header region parallel to the joining seam possibly closing completely the header region over a predetermined section. In particular the predetermined separation line has a minimum length of between about a sixth and a third of the width of the packaging; this is in order to ensure as a function of the packaging width a sufficiently large removal opening and linked with that an advantageously simple removal of the filler material. The configuration of the predetermined separation line is thereby fully independent of the shape or form of the inventive header region, or the configuration or the number of joining seams connecting the plurality of layers in the header region.

In the region of the predetermined separation line at least one reclosable device is arranged, by means of which the removal region is designed with advantage such that it can be reclosed. In particular in the case in which filler materials are only extracted in portions from the packaging, there exists as a result of the reclosable device the possibility of closing the removal region in a sealed manner, in order to keep the effects of possible environmental influences, such as, for example, moisture or dirt particles on the filler material remaining in the packaging as low as possible. The reclosable device is also with advantage arranged in the two-layer region of the packaging, as a result of which in conjunction with a strip of pouches created during the manufacture of the packaging an advantageously even winding of the strip of pouches into a roll is possible.

Here predetermined regions of the reclosable device are connected with at least one inner side of the front and/or rear wall by means of at least one closing seam, by means of which the removal region is separated from the fill space. With the aid of the closing seam on the one hand parts of the reclosable device are fixed on predetermined surface area regions of the inner faces of front and rear walls, and on the other hand it is ensured that the filler material cannot inadvertently escape from the fill space. In particular the closing seam likewise runs in the region of the reclosable device parallel to the multi-layer header region of the packaging and is angled behind the reclosable device by, for example, 90° in the direction of the header region, and runs out, for example, at the joining seam that is possibly fixing all layers in the header region one upon another. Here the closing parts can be attached in each case to the inner faces of the front and rear walls. It is also conceivable to join the closing parts with the inner face of only one of the walls, so that the removal opening is then formed either on the front or the rear wall. As is the case for the predetermined separation line formed on the packaging the reclosable device can also be varied in conjunction with each possible example of embodiment of the inventive header region.

Another further development of the invention envisages that corner welds are provided in the base region, by means of which surface area regions of the inner faces of outer and inner layers, lying one upon another, are connected together. With the formation of corner welds in the base region of the packaging an improved stability of the stand base is advantageously ensured. Thus the inventive packaging can be transported or presented relatively securely while standing on its stand base. In particular a corner weld is formed by means of a joining seam running at an angle of about 45° to the side seam and the base edge, wherein each joining seam runs out at about the height of the inner layers ending between the outer layers in an appropriate side seam of the packaging. In order to avoid any weakening of the packaging wall in the base region as a result of the weld, the weld seam of each corner weld preferably runs out flatter relative to the fold edge bounding the stand base of the packaging.

DESCRIPTION OF THE DRAWINGS

Examples of embodiment of the invention, from which further inventive features ensue, are represented in the figures. Here.

DETAILED DESCRIPTION OF THE INVENTION

Figure 1:
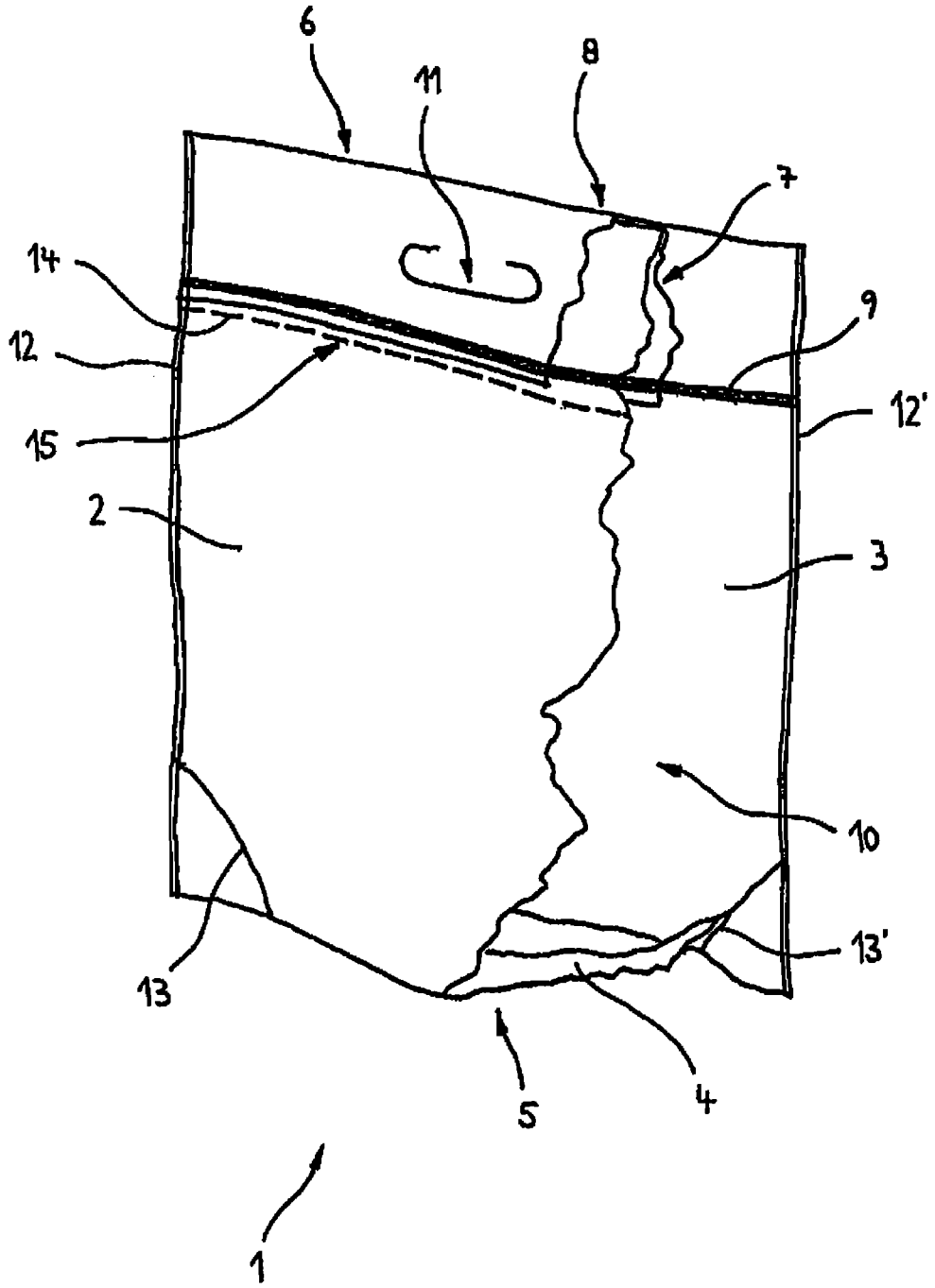
FIG. 1: shows a perspective view of a first example of embodiment of a filled inventive packaging.

A packaging for filler materials is designated as 1; this has a front wall 2, a rear wall 3 and a stand base 4. Here the stand base 4 is created by the folding in along a longitudinal face of at least one tubular web section folded in the longitudinal direction. Thus in its flat state the packaging is appropriately formed with four layers in its base region 5. Moreover the packaging likewise has a four-layer header region 6, which is created by a fold-over 7 of the front wall 2 turned over at its upper end to form a multi-layer region, and the fold-over 8 of the rear wall 3 turned over the multi-layer region. In this form of embodiment the four layers in the header region 6 of the packaging are joined together via a joining seam 9, so that the header region 6 is separated from the fill space 10 for the filler material. In addition a carrying aid 11 is provided in the header region 6 separated from the fill space 10; this is formed as a perforation penetrating all layers in the header region. Here the carrying aid has, for example, an advantageous size such that it can be gripped by at least the fingers of one hand. The packaging 1 is closed on its faces via side seams 12, 12' formed as welds, wherein each side seam joins together all four layers in the base region 5 and header region 6, and in the section between head and base region joins together the front wall 3 and the rear wall 3. For increased stability of the stand base 4 the packaging 1 in the base region has corner welds 13, 13', which join the inner layers created by the folding in of the tubular web section with the inner faces of the front and rear walls. In addition a predetermined separation line 14 is formed in the front wall 2 of the packaging 1 underneath the header region 6, by means of which a removal region, i.e. a removal opening 15, is created for the filler material. Here the predetermined separation line 15 extends parallel to the joining seam 9 from one side seam 12 across to the other side seam 12'.

Figure 2:
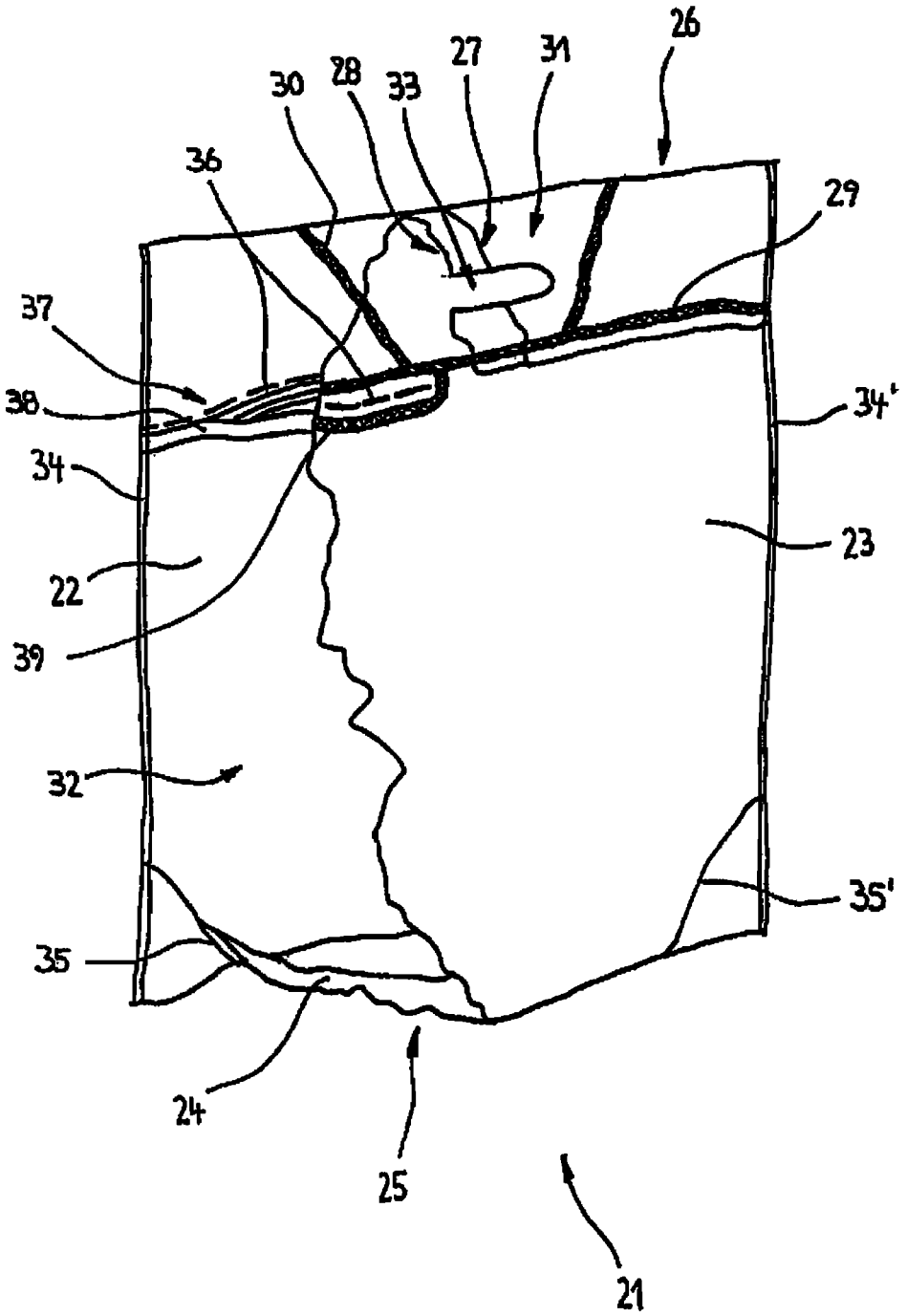
FIG. 2: shows a perspective view of a second example of embodiment of a filled inventive packaging.

FIG. 2 shows a further inventive example of embodiment of a packaging 21, which likewise has a front wall 22 and a rear wall 23. Front and rear walls 22, 23 are likewise joined together via a stand base 24 in the base region 25. In the header region 26 fold-overs 27, 28 are provided at the upper ends of the front and rear walls 22, 23 in each case. Here in this example of embodiment the two upper ends of the front and rear walls 22, 23 are folded over together so that the inner faces of the walls in the header region lie one upon another. Only three of the four layers in the header region 26 are then joined together by means of the joining seam 29, so that at least one sealed closure of the packaging 21 is ensured, and moreover the fold-overs 27, 28 are fixed on the outer face of the front wall 22. In addition an additional joining seam 30 is provided in the header region, by means of which only a sub-region 31 of the header region 26 is separated from the fill space 32 of the packaging 21. In the sub-region 31 of the header region 26 separated from the fill space a carrying aid 33 is again provided, by means of which the transport of the packaging 21 is simplified. Instead of a perforation penetrating all four layers of the header region only two of the four layers are penetrated, as a result of which a kind of grip is formed. In addition the packaging 21 is again closed on its faces via side seams 34, 34' and has corner welds 35, 35' in the region of the stand base. A predetermined separation line 36 is formed underneath the header region 26; this originates from the side seam 12 and extends over a section in both the front wall 22 and also the rear wall 23, by means of which a removal region 37 is created for the filler material located in the packaging 21. In addition in the removal region 37 a reclosable device 38 is arranged, by means of which the packaging 21, after partial removal of the filler material, can be closed once again. In order to seal the removal region a closing seam 39 is provided, which connects the closing parts of the reclosable device 38 with the inner faces of the front and rear walls 22, 23 and in addition seals the removal region 37 from the fill space 32.

Figure 3:
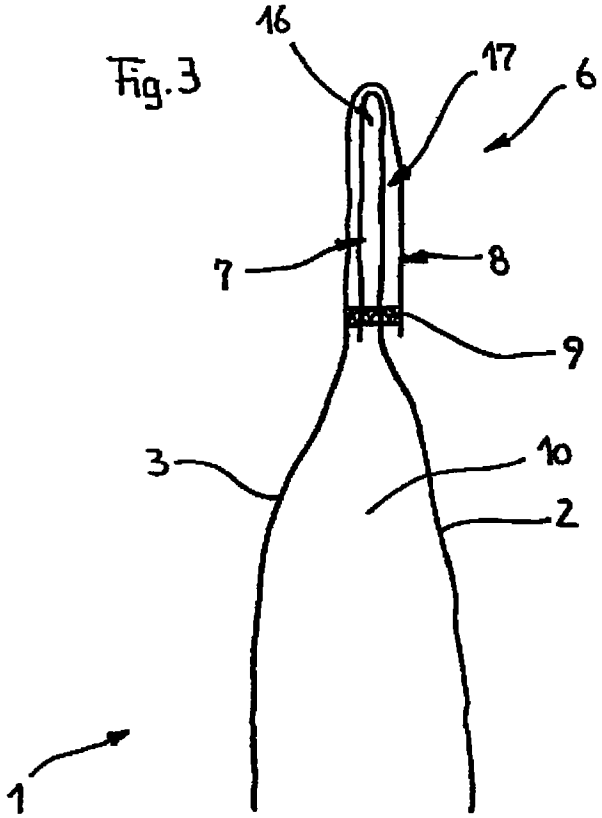
FIG. 3: shows a partial view of one of the inventive packagings in cross-section.

FIG. 3 represents in particular a partial view of the packaging as per FIG. 1; in particular this is designed to illustrate the structure in the header region 6. As can be seen from FIG. 3, front and rear walls 2, 3 in the header region have fold-overs 7, 8, wherein the upper wall section of the front wall 2 is folded over upon itself and thereby a multi-layer region 16 is created. The inner face of the upper wall section of the rear wall 3 is directly folded over upon the multi-layer region 16, so that an overlap region 17 ensues between the upper wall sections of the front and rear walls 2, 3. In the present example of embodiment the upper wall section of the front wall is folded such that surface area sections of the inner faces are laid one upon another so as to form the multi-layer region 16. In this case the joining seam 9 joins all layers in the header region 6 together, as a result of which the latter is separated from the fill space 10 (FIG. 1).

Figure 4:
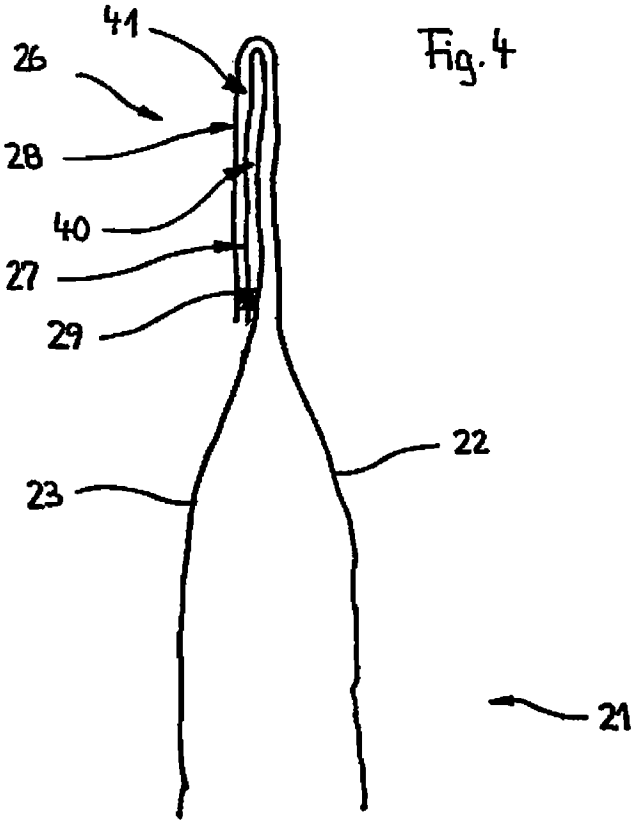
FIG. 4: shows a partial view of a further inventive packaging in cross-section.

FIG. 4 represents a partial view of the packaging 21 as per FIG. 2. The upper wall sections of the front and rear walls 22, 23 are folded over together and have fold-overs 27, 28 in each case. In this embodiment the upper wall section of the rear wall 23 is here likewise folded over upon itself so as to form a multi-layer region 40. The upper wall section of the front wall 22 with its inner face is now folded over upon the multi-layer region 40 so as to form the overlap region 41. In this embodiment, however, surface area sections of the outer face of the rear wall 23 are laid one upon another so as to form the multi-layer region 40. Front and rear walls 22, 23 are thus in direct contact with one another in each case via their inner faces. The joining seam 29 provides a material bond between the folded-over sections of the front and rear walls, so that the packaging 21 is securely closed. In addition only the fold-overs 27, 28 are fixed on the outer face of the rear wall 23 via the joining seam 29. Only by means of the additional joining seam 30 is a sub-region 31 created, separated from the fill space 32 (FIG. 2) for a carrying aid 33 to be formed in the header region 26.

The invention claimed is:

1. A packaging for filler materials with a packaging wall for enclosing a filler material, which packaging is formed by means of at least one front and one rear wall (2, 3, 22, 23), wherein the front and rear walls are joined together in the base region (5, 25) by means of a stand base (4, 24) that is formed from at least two inner layers of an in-fold of a tubular web section folded on at least one side in the longitudinal direction, wherein the front and rear walls (2, 3, 22, 23) in the header region (6, 26) of the packaging (1) have in each case a fold-over (7, 8, 27, 28), the upper wall section of one of the walls (2, 23) is folded over upon itself so as to form a multi-layer region (16, 40), the multi-layer region (16) is formed by the laying one upon another of surface area sections of an inner face of a corresponding wall (2), wherein a surface area section of the inner face of the wall (2) is in contact with the fill space (10) of the packaging, at least one joining seam (9, 29) is provided, by means of which joining seam certain layers of the walls (2, 3, 22, 23) at least partially closing the packaging (1, 21) are joined together, and the upper wall section of the other wall (3, 22) is folded over with its inner face onto the multi-layer region (16, 40) so as to form an overlap region (17, 41), wherein a surface area section of the inner face of the other wall (3,22) is in contact with the fill space (10) of the packaging, and the at least one joining seam is located in the overlap region (17, 41).

2. The packaging in accordance with claim 1, wherein a header region (6) that is separated from the fill space (10) of the packaging (1) is formed by means of the joining seam (9).

3. The packaging in accordance with claim 1, wherein at least one sub-region (31) of the multi-layer header region (26) is separated from the fill space (32) of the packaging (21) by at least one additional joining seam (30).

4. The packaging in accordance with claim 2 or 3, further comprising at least one carrying aid (11, 33) provided in the header region (6, 26) separated from the fill space (10, 32), wherein the carrying aid is formed as a perforation penetrating predetermined layers of the header region (6, 26).

5. The packaging in accordance with claim 1, wherein at least one of the walls (2, 22, 23) has a predetermined separation line (14, 36) that weakens the wall material so as to form a removal region (15, 37).

6. The packaging in accordance with claim 5, wherein the predetermined separation line (14, 36) extends over at least one section underneath the multi-layer header region (6, 26).

7. The packaging in accordance with claim 5, further comprising at least one reclosable device (38), wherein the reclosable device is arranged in the region of the predetermined separation line (36), by means of which the removal region (37) is designed such that it can be reclosed.

8. The packaging in accordance with claim 7, wherein regions of the reclosable device (38) are joined with at least one inner face of the front and/or rear wall (22, 23) by means of at least one closing seam (39), by means of which the removal region (37) is separated from the fill space (32).

9. The packaging in accordance with claim 1, wherein corner welds (13, 13', 35, 35') are formed in the base region (5, 25), by means of which surface area regions of the inner faces of outer and inner layers, lying one upon another, are joined together.

10. The packaging in accordance with claim 1, wherein the packaging is a bag or pouch made of a plastic film.

11. The packaging in accordance with claim 1, wherein the packaging is formed by means of at least one front and one rear wall (2, 3), wherein the front and rear walls are joined together in the base region (5) by means of a stand base (4) that is formed from at least two inner layers of an in-fold of a tubular web section folded on at least one side in the longitudinal direction, wherein the front and rear walls (2, 3) in the header region (6) of the packaging (1) have in each case a fold-over (7, 8), the upper wall section of one of the walls (2) is folded over upon itself so as to form a multi-layer region (16), the multi-layer region (16) is formed by the laying one upon another of surface area sections of the inner face of the corresponding wall (2)

at least one joining seam (9) is provided, by means of which joining seam certain layers of the walls (2, 3) at least partially closing the packaging (1) are joined together, and the upper wall section of the other wall (3) is folded over with its inner face onto the multi-layer region (16) so as to form an overlap region (17), and the at least one joining seam is located in the overlap region (17).

12. The packaging in accordance with claim 11, wherein a header region (6) that is separated from the fill space (10) of the packaging (1) is formed by means of the joining seam (9).

13. The packaging in accordance with claim 12, further comprising at least one carrying aid (11) provided in the header region (6) and separated from the fill space (10), wherein the carrying aid is formed as a perforation penetrating predetermined layers of the header region (6).

14. The packaging in accordance with claim 11, wherein wall (2) has a predetermined separation line (14) that weakens the wall material so as to form a removal region (15).

15. The packaging in accordance with claim 14, wherein the predetermined separation line (14) extends over at least one section underneath the multi-layer header region (6).

* * * * *